US009551176B2

(12) United States Patent
Sasa et al.

(10) Patent No.: US 9,551,176 B2
(45) Date of Patent: Jan. 24, 2017

(54) DOOR HINGE FOR AUTOMOBILE AND METHOD FOR MANUFACTURING FIRST BRACKET THEREOF

(71) Applicant: RIKENKAKI KOGYO KABUSHIKI KAISHA, Sakado-shi, Saitama (JP)

(72) Inventors: Seiji Sasa, Sakado (JP); Manabu Ochiai, Sakado (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 14/765,720

(22) PCT Filed: Feb. 4, 2014

(86) PCT No.: PCT/JP2014/052547

§ 371 (c)(1),
(2) Date: Aug. 4, 2015

(87) PCT Pub. No.: WO2014/123113

PCT Pub. Date: Aug. 14, 2014

(65) Prior Publication Data

US 2015/0368945 A1 Dec. 24, 2015

(30) Foreign Application Priority Data

Feb. 5, 2013 (JP) ..... 2013-020819

(51) Int. Cl.
*E05D 5/06* (2006.01)
*E05D 9/00* (2006.01)
(Continued)

(52) U.S. Cl.
CPC ..... *E05D 5/062* (2013.01); *E05D 3/02* (2013.01); *E05D 9/00* (2013.01); *E05D 11/06* (2013.01);
(Continued)

(58) Field of Classification Search
CPC .. Y10T 16/551; Y10T 16/558; Y10T 16/5595; Y10T 29/24; E05D 11/06; E05D 11/1071; E05D 11/1085; E05D 2011/009; E05D 5/062; E05D 5/0207; E05D 3/02; E05D 9/00; E05Y 2800/45; E05Y 2800/465; E05Y 2800/67; E05Y 2800/674; E05Y 2800/682; E05Y 2900/50; E05Y 2900/531; E05Y 53/40
See application file for complete search history.

(56) References Cited

U.S. PATENT DOCUMENTS 3,663,987 A * 5/1972 Hawkins ..... E05D 5/06 16/387
4,766,643 A * 8/1988 Salazar ..... E05D 7/105 16/222
(Continued)

FOREIGN PATENT DOCUMENTS

CN 101748948 A 6/2010
CN 102905811 A 1/2013
(Continued)

OTHER PUBLICATIONS

Official Communication corresponding to Chinese Application 201480007386.7 dated Mar. 18, 2016.
(Continued)

*Primary Examiner* — Chuck Mah
(74) *Attorney, Agent, or Firm* — Carrier Blackman & Associates, P.C.; William D. Blackman; Anne G. Sabourin

(57) ABSTRACT

A door hinge for an automobile includes a first bracket fixed to a body, a second bracket fixed to a door, and a hinge pin, the first bracket including a base plate portion having a bolt hole, a pair of arm plate portions standing up from upper and lower edges of one end part, on the door side, of the base plate portion and supporting the hinge pin, and a pair of rib portions extending from the arm plate portion and standing
(Continued)

up from the upper and lower edges of the base plate portion so as to oppose each other with the bolt hole interposed therebetween, wherein opposite end parts, perpendicular to the extending direction of the rib portion, of the base plate portion are open, and the rib portion is formed so as to have a thickness larger than a thickness of the arm plate portion.

7 Claims, 6 Drawing Sheets

(51) Int. Cl.
*E05D 11/06* (2006.01)
*E05D 3/02* (2006.01)

(52) U.S. Cl.
CPC ..... *E05Y 2800/45* (2013.01); *Y10T 16/554* (2015.01); *Y10T 16/5518* (2015.01)

(56) References Cited

U.S. PATENT DOCUMENTS 4,794,669 A * 1/1989 Sanders ..... E05D 11/1057 16/341
5,444,894 A * 8/1995 Heiler ..... E05D 7/121 16/257
5,570,498 A * 11/1996 Hipkiss ..... E05D 7/1044 16/258
5,611,114 A * 3/1997 Wood, Jr. ..... E05D 3/127 16/366
6,079,403 A 6/2000 Binder
6,427,287 B1 * 8/2002 Brueckner ..... E05D 11/10 16/342
6,591,451 B2 7/2003 Gruber et al.
6,922,872 B2 8/2005 Gruber
7,076,836 B1 * 7/2006 Butka ..... E05C 21/005 16/334
7,725,990 B2 * 6/2010 Patzold ..... E05D 11/00 16/387
7,748,768 B2 * 7/2010 Hofacker ..... E05D 5/121 16/374
7,908,712 B2 * 3/2011 Rudzewski ..... E05D 11/06 16/334
8,108,969 B2 2/2012 Ochiai
8,770,606 B2 7/2014 Lindtner et al.
2003/0233732 A1 12/2003 Kohlstrand et al.
2004/0111833 A1 * 6/2004 Janczak ..... E05D 5/0207 16/221
2005/0210630 A1 * 9/2005 Lowen ..... E05D 5/062 16/379
2006/0218749 A1 * 10/2006 Brown ..... E05D 11/1042 16/332
2010/0024164 A1 * 2/2010 Machin ..... E05D 7/121 16/258
2011/0035906 A1 * 2/2011 Esaki ..... E05D 3/02 16/374
2012/0227215 A1 * 9/2012 Katou ..... E05D 5/062 16/273
2013/0061437 A1 * 3/2013 Ogawa ..... B21D 28/32 29/11

FOREIGN PATENT DOCUMENTS

CN 202706740 U 1/2013
GB 2080403 A * 2/1982 ..... B21D 53/40
GB 2082671 A * 3/1982 ..... B21D 53/40
JP 2721815 B2 3/1998
JP 3005940 B2 2/2000
JP 3449190 B2 9/2003
JP 4030225 B2 1/2008
JP 4084748 B2 4/2008
JP 4160777 B2 10/2008
JP 2009-024429 A 2/2009
JP 2013100709 A * 5/2013

OTHER PUBLICATIONS

Official Communication issued over the corresponding Chinese Patent Application 2014800073867.

* cited by examiner

DOOR HINGE FOR AUTOMOBILE AND METHOD FOR MANUFACTURING FIRST BRACKET THEREOF

TECHNICAL FIELD

The present invention relates to a door hinge for an automobile that links a door for opening and closing an entrance or a tailgate of the automobile to a body, and a method for manufacturing a first bracket of the door hinge that is fixed to the body.

BACKGROUND ART

A conventional door hinge for an automobile is formed from a first bracket fixed to a body by means of a bolt, a second bracket fixed to a door, and a hinge pin relatively pivotably linking these two brackets, the first bracket being formed from a base plate portion having a bolt hole through which the bolt is inserted, a pair of arm plate portions standing up from upper and lower edges of one end part, on the door side, of the base plate portion and supporting the hinge pin, and a pair of rib portions extending from the arm plate portion toward the other end part side of the base plate portion and standing up from upper and lower edges of the base plate portion so as to oppose each other with the bolt hole interposed therebetween.

In such a door hinge for an automobile, since the first bracket for the body supports the entire weight of the door when the door is open, the base plate portion in particular, which is joined to the body by means of a bolt, is required to have high stiffness, and in order to satisfy this requirement, in the conventional arrangement a reinforcing wall linking the pair of arm plate portions is made to stand up from an end part, on the arm plate portion side, of the base plate portion (refer to Patent Document 1).

RELATED ART DOCUMENTS

Patent Documents

Patent Document 1: Japanese Patent Application Laid-open No. 2009-24429

SUMMARY OF THE INVENTION

Problems to be Solved by the Invention

As described above, when the reinforcing wall linking the pair of arm plate portions is made to stand up from an end part, on the arm plate portion side, of the base plate portion, since the pair of arm plate portions and the reinforcing wall are made to stand up from three sides of the base plate portion, production of the first bracket requires a drawing process, which has a relatively high processing cost. Therefore, it is difficult to reduce the processing cost for the structure of the first bracket of the conventional door hinge.

The present invention has been accomplished in light of such circumstances, and it is an object thereof to provide a door hinge for an automobile equipped with a first bracket that is easy to process and can ensure high stiffness, and to provide a method for manufacturing the first bracket thereof.

Means for Solving the Problems

In order to attain the above object, according to a first aspect of the present invention, there is provided a door hinge for an automobile, comprising a first bracket fixed to a body by a bolt, a second bracket fixed to a door, and a hinge pin relatively pivotably linking these two brackets, the first bracket comprising a base plate portion having a bolt hole through which the bolt is inserted, a pair of arm plate portions standing up from upper and lower edges of one end part, on the door side, of the base plate portion and supporting the hinge pin, and a pair of rib portions extending from the arm plate portion toward the other end part side of the base plate portion and standing up from the upper and lower edges of the base plate portion so as to oppose each other with the bolt hole interposed therebetween, characterized in that opposite end parts, perpendicular to the extending direction of the rib portion, of the base plate portion are open, and the rib portion is formed so as to have a thickness that is larger than a thickness of the arm plate portion.

Further, according to a second aspect of the present invention, in addition to the first aspect, the rib portion is formed so that an outside face thereof protrudes more than an outside face of the arm plate portion.

Furthermore, according to a third aspect of the present invention, in addition to the first aspect, a corner formed by an outside face of the rib portion and an outside face of the base plate portion is formed so as to be acute compared with a corner formed by the outside face of the arm plate portion and the outside face of the base plate portion.

Moreover, according to a fourth aspect of the present invention, in addition to any one of the first to third aspects, in order to restrict a fully open position of the door a fully-open stopper projection having a semi-circular cross section with a flat stopper face that receives the arm plate portion of the second bracket is formed so as to bulge on an inside face of the arm plate portion of the first bracket.

Further, according to a fifth aspect of the present invention, there is provided a method for manufacturing the first bracket of the door hinge for an automobile, comprising a step of stamping out a starting steel plate to form a flat-plate bracket substrate having portions corresponding to the base plate portion, the arm plate portion, and the rib portion, a step of bending the arm plate portion and the rib portion at right angles relative to the base plate portion of the bracket substrate to thus obtain a partially-finished bracket product, and a step of thickening the rib portion of the partially-finished bracket product by an upsetting process, the steps being carried out in sequence.

Effects of the Invention

In accordance with the first aspect of the present invention, since the opposite end parts, perpendicular to the extending direction of the rib portion, of the base plate portion are made open, and the rib portion is formed so that the thickness thereof is larger than the thickness of the arm plate portion, it is possible to increase effectively the stiffness of the rib portion, make the stress be sufficiently borne by the rib portion, and relieve the stress from the area around the bolt hole of the base plate portion, thus increasing the stiffness of the base plate portion and enabling the door to be strongly supported, and it is also possible to reduce the thickness of the entire first bracket, thereby achieving a reduction in the weight of the first bracket. Moreover, since the base plate portion is formed into a flat plate shape with the opposite end parts open, it becomes possible to form the arm plate portion and the rib portion by simple bending, and it is also possible to easily increase the thickness by subjecting the rib portion to simple upsetting, thereby contributing to a reduction of the processing cost.

In accordance with the second aspect of the present invention, since the rib portion is formed so that the outside face thereof protrudes further from the outside face of the arm plate portion, the width of the base plate portion increases by a portion corresponding to the increase in thickness of the rib portion, thus further increasing the stiffness of the base plate portion, and the area of the base plate portion that is joined to the body increases, thus enhancing the stability with which the base plate portion is supported on the body.

In accordance with the third aspect of the present invention, since the corner formed from the outside face of the rib portion and the outside face of the base plate portion is formed so as to be acute compared with the corner formed from the outside face of the arm plate portion and the outside face of the base plate portion, not only is it possible to enhance the stiffness of the rib portion, but it is also possible to increase the area of the base plate portion that is joined to the body, thereby yet further enhancing the stability with which the base plate portion is supported on the body.

In accordance with the fourth aspect of the present invention, since, in order to restrict the fully open position of the door, the fully-open stopper projection having a semi-circular cross section with the flat stopper face that receives the arm plate portion of the second bracket is formed so as to bulge on an inside face of the arm plate portion of the first bracket, when the door is open the arm plate portion of the second bracket abuts against the flat stopper face of the fully-open stopper projection, thus enabling the fully open position of the door to be restricted. In this arrangement, since the flat stopper face is in flat surface contact with the arm plate portion of the second bracket, the contact surface pressure is held comparatively low and, moreover, since the stopper projection has a semicircular cross-sectional shape, which has high stiffness, the durability can be maintained. Furthermore, since the stopper projection is formed so as to bulge on the inside face of the arm plate portion, there is no increase in the number of components, thus contributing to simplification of the structure.

In accordance with the fifth aspect of the present invention, due to the step of stamping out a starting steel plate to form a flat-plate bracket substrate having portions corresponding to the base plate portion, the arm plate portion, and the rib portion, the step of bending the arm plate portion and the rib portion at right angles relative to the base plate portion of the bracket substrate to thus obtain a partially-finished bracket product, and the step of thickening the rib portion of the partially-finished bracket product by an upsetting process being carried out in sequence, it is possible to easily obtain a first bracket having a base plate portion with open opposite end parts and having a thickened rib portion, thus enabling the processing cost to be reduced while enhancing the stiffness of the first bracket.

EXPLANATION OF REFERENCE NUMERALS AND SYMBOLS

Figure 1:
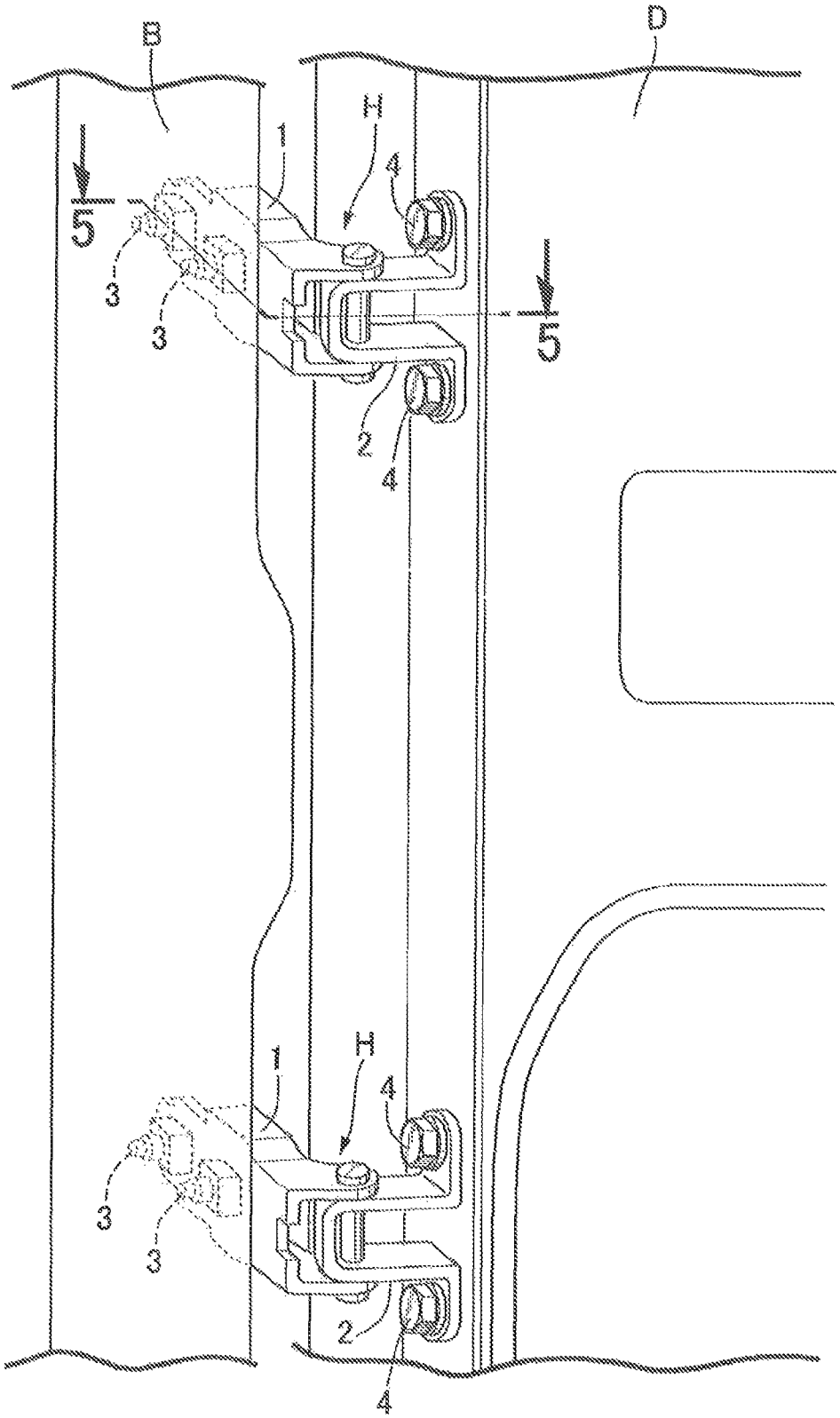
FIG. 1 is a plan view of an essential part of an automobile equipped with a door hinge related to an embodiment of the present invention. (first embodiment)

B Body
D Door
H Door hinge
T1 Thickness of arm plate portion of first bracket
T2 Thickness of rib portion of first bracket
1 First bracket
1*a* Base plate portion of first bracket
1*b* Arm plate portion of first bracket
1*c* Rib portion of first bracket
2 Second bracket
2*a* Base plate portion of second bracket
2*b* Arm plate portion of second bracket
3 Bolt
5 Hinge pin
8 Bolt hole
9 Corner on arm plate portion side of first bracket
10 Corner on rib portion side of first bracket
12 Fully-open stopper projection
12*a* Stopper face
20 Starting steel plate
21 Bracket substrate
22 Partially-finished bracket product

MODES FOR CARRYING OUT THE INVENTION

An embodiment of the present invention is explained below by reference to the attached drawings.

First Embodiment

First, in FIG. 1, a door D is pivotably mounted on a body B of an automobile via a pair of upper and lower door hinges H in order to open and close its entrance.

Figure 2:
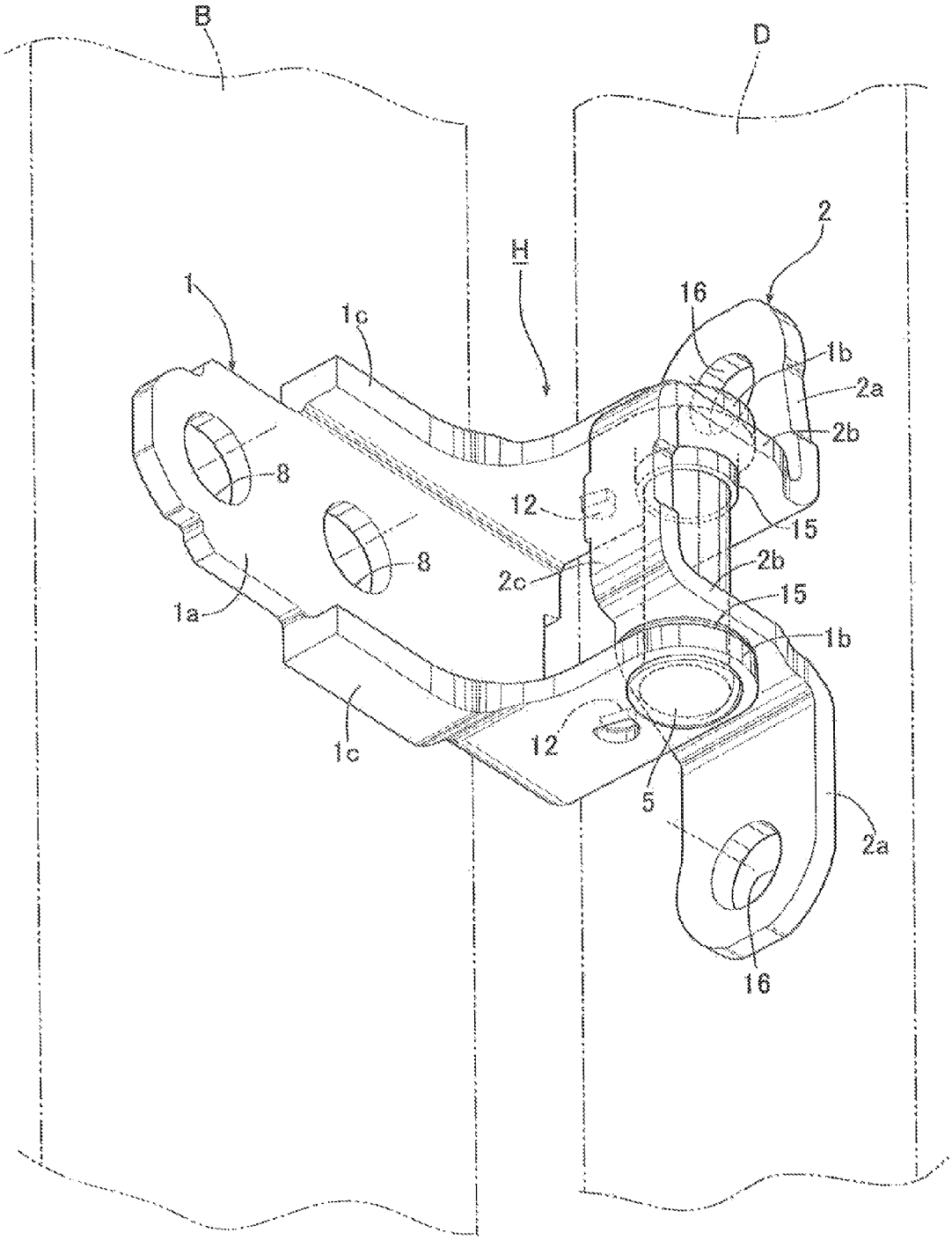
FIG. 2 is a perspective view of the door hinge. (first embodiment)
Figure 3:
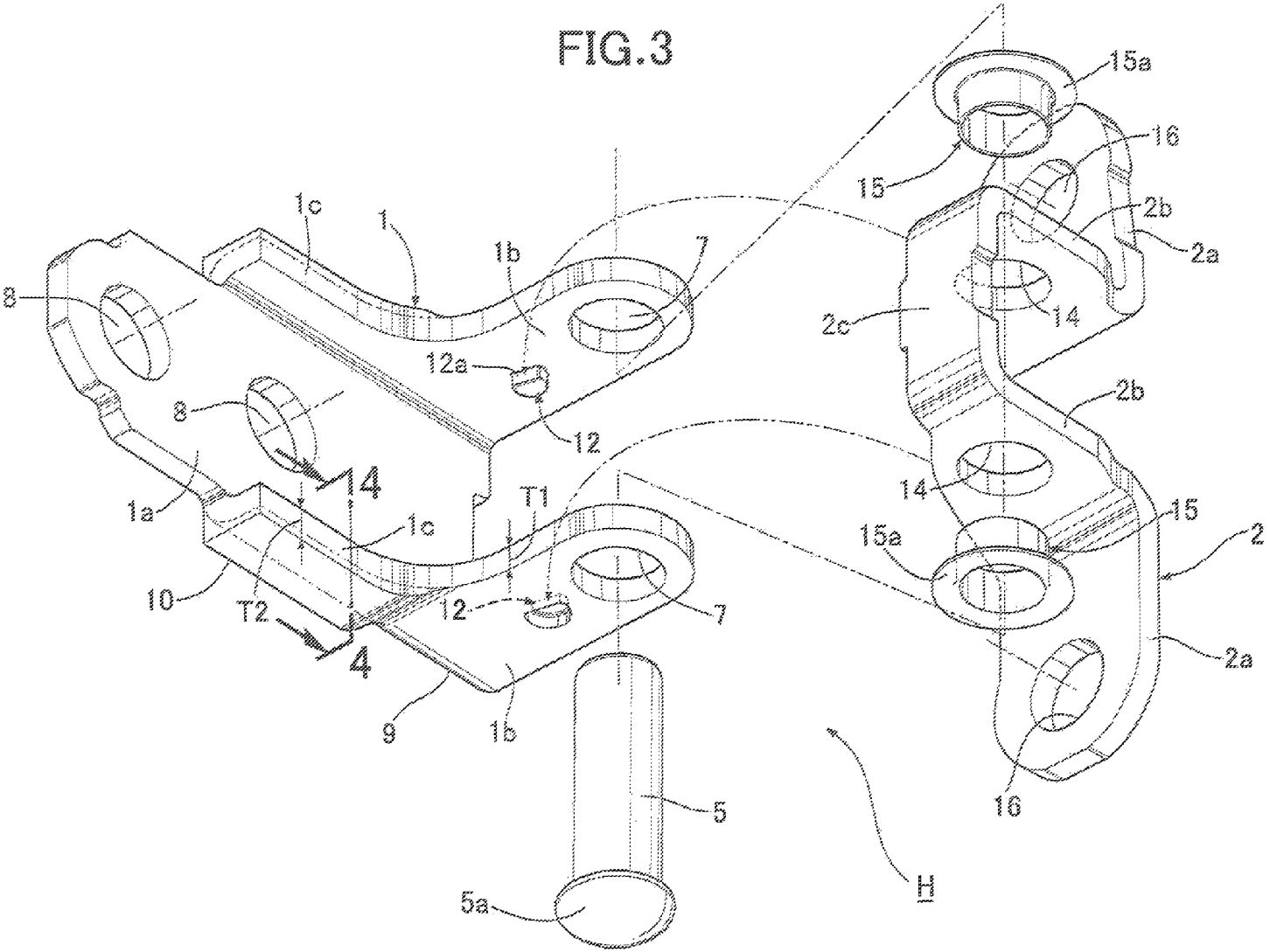
FIG. 3 is an exploded perspective view of the same door hinge. (first embodiment)
Figure 4:
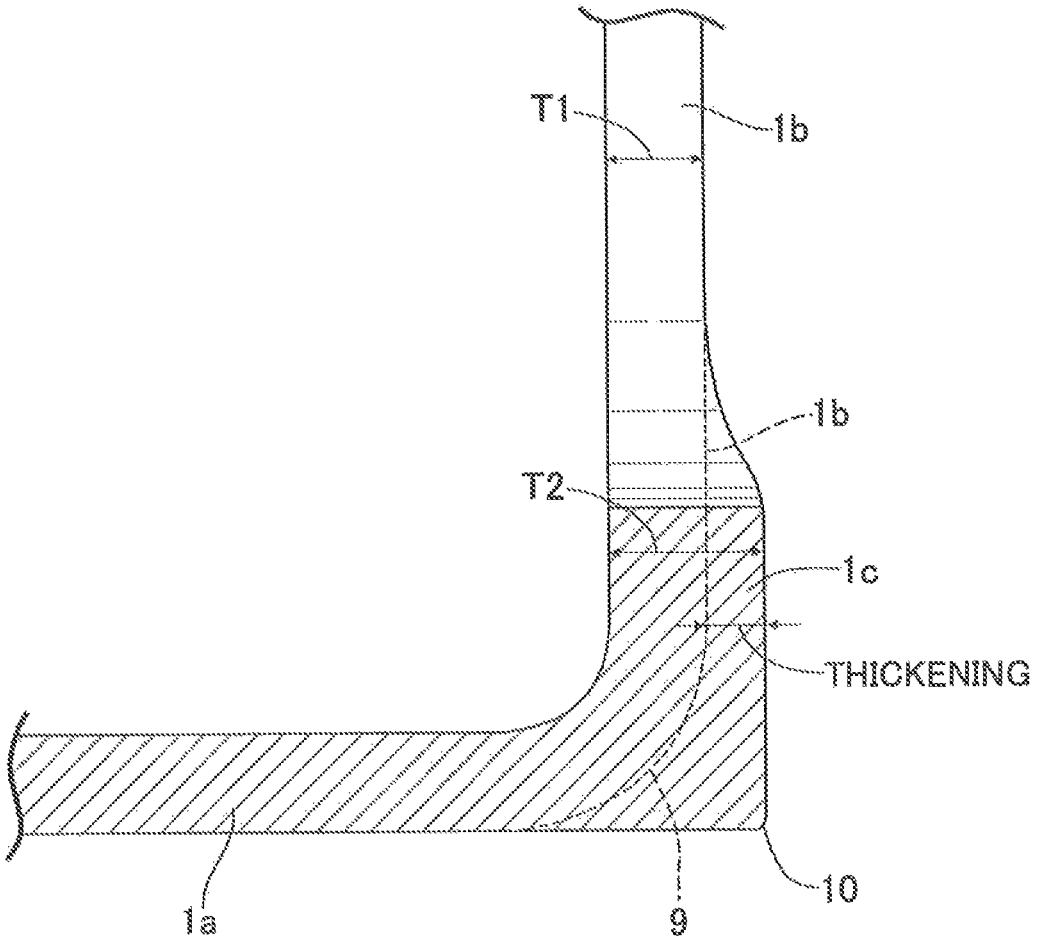
FIG. 4 is an enlarged sectional view along line 4-4 in FIG. 3. (first embodiment)

As shown in FIG. 2 to FIG. 4, each door hinge H is formed from a first bracket 1 fixed to the body B by means of a pair of bolts 3, a second bracket 2 fixed to the door D by means of a pair of bolts 4, and a hinge pin 5 vertically disposed so as to relatively pivotably link these two brackets 1 and 2.

The first bracket 1 is formed from a base plate portion 1*a*, a pair of arm plate portions 1*b* and 1*b* standing up from upper and lower edges of one end part, on the door D side, of the base plate portion 1*a*, and a pair of rib portions 1*c* and 1*c* standing up from the upper and lower edges of the base plate portion 1*a* so as to extend from the arm plate portions 1*b* and 1*b* toward the other end part side of the base plate portion 1*a*, the base plate portion 1*a* having opposite end parts perpendicular to the extending direction of the rib portions 1*c* and 1*c* open. Bored in the base plate portion 1*a* are a pair of bolt holes 8 and 8 through which the pair of bolts 3 and 3 are inserted, and bored in the arm plate portions 1*b* and 1*b* are pin holes 7 and 7 through which the hinge pin 5 is inserted.

Each rib portion 1*c* is formed so that a thickness T2 thereof is larger than a thickness T1 of the arm plate portion 1*b*, and an outside face of the rib portion 1*c* protrudes further than an outside face of the arm plate portion 1*b*. Furthermore, a corner 10 formed from the outside face of the rib portion 1*c* and an outside face of the base plate portion 1*a* is formed so as to be acute compared with a corner 9 formed from the outside face of the arm plate portion 1*b* and the outside face of the base plate portion 1*a*.

Integrally and projectingly provided on the inside face of the arm plate portion 1*b* is a fully-open stopper projection 12 for receiving an arm plate portion 2*b*, which is described later, of the second bracket 2 in order to restrict the fully open position of the door D. This fully-open stopper projection 12 is formed so as to bulge on the inside face of the arm plate portion 1*b* by pressing out the arm plate portion 1*b* from the outside face side, and has a semicircular cross-sectional shape having a flat stopper face 12*a* on one side.

On the other hand, the second bracket 2 is formed from the pair of upper and lower arm plate portions 2*b* and 2*b*, a linking plate portion 2*c* integrally linking extremities of the two arm plate portions 2*b* and 2*b*, and a pair of base plate portion 2*a* and 2*a* protruding while bending from the base end of the respective arm plate portion 2*b* toward the outside. Bored in the base plate portions 2*a* and 2*a* are bolt holes 16 and 16 through which the bolts 4 and 4 are inserted.

A washer 15*a*-equipped bush 15 is fitted in each of pin holes 14 and 14 of the arm plate portions 2*b* and 2*b*. The arm plate portions 2*b* and 2*b* are inserted between the arm plate portions 1*b* and 1*b* of the first bracket 1, and in this process the washer 15*a* of the bush 15 is disposed between the arm plate portions 1*b* and 2*b*.

The hinge pin 5, which is equipped with an expanded head portion 5*a*, is inserted through the pin holes 7 and 7 of the arm plate portions 1*b* and 1*b* and the bushes 15 and 15 of the arm plate portions 2*b* and 2*b*, and the extremity of the hinge pin 5 is swaged. In this way, the first and second brackets 1 and 2 are relatively pivotably linked via the hinge pin 5, thus forming the door hinge H.

The operation of this embodiment is now explained.

The door hinge H is mounted on the body B by securing the base plate portion 1*a* of the first bracket 1 to the body B by means of the bolts 3 and 3 inserted through the bolt holes 8 and 8, and the door D is supported on the first bracket 1 via the second bracket 2 and the hinge pin 5 so that it can freely open and close by securing the door D to the base plate portions 2*a* and 2*a* of the second bracket 2 by means of the bolts 4 and 4 inserted through the bolt holes 16 and 16 of the base plate portions 2*a* and 2*a*.

Therefore, when the door D is open, the entire weight thereof is imposed on the first bracket 1, and the weight burden on the base plate portion 1*a*, which is secured by means of the bolts 3 and 3, is large. In particular, it has been found from stress analysis that, due to the base plate portion 1*a* being formed into a flat plate shape with opposite end parts thereof open, stress is concentrated not only in the rib portion 1*c* but also in an area around the bolt holes 8 and 8 of the base plate portion 1*a*.

In the present invention, as described above, since the rib portion 1*c* is formed so that the thickness T2 thereof is larger than the thickness T1 of the arm plate portion 1*b*, it is possible to increase effectively the stiffness of the rib portion 1*c*, make the stress be sufficiently borne by the rib portion 1*c*, and relieve the stress from the area around the bolt holes 8 and 8 of the base plate portion 1*a*, thus increasing the stiffness of the base plate portion 1*a* and enabling the door D to be strongly supported, and it is also possible to reduce the thickness of the entire first bracket 1, thereby achieving a reduction in the weight of the first bracket 1.

Moreover, in the first bracket 1, since the base plate portion 1*a* is formed into a flat plate shape with the opposite end parts open, it becomes possible to form the arm plate portions 1*b* and 1*b* and the rib portions 1*c* and 1*c* by simple bending, and it is also possible to easily increase the thickness by subjecting the rib portion 1*c* to simple upsetting, thereby contributing to a reduction of the processing cost.

Furthermore, when forming the rib portion 1*c* so as to have large thickness, since the rib portion 1*c* is formed so that the outside face thereof protrudes further from the outside face of the arm plate portion 1*b*, the width of the base plate portion 1*a* increases by a portion corresponding to the increase in thickness of the rib portions 1*c* and 1*c*, thus further increasing the stiffness of the base plate portion 1*a*, and the area of the base plate portion 1*a* that is joined to the body B increases, thus enhancing the stability with which the base plate portion 1*a* is supported on the body B.

Moreover, since the corner 10 formed from the outside face of the rib portion 1*c* and the outside face of the base plate portion 1*a* is formed so as to be acute compared with the corner 9 formed from the outside face of the arm plate portion 1*b* and the outside face of the base plate portion 1*a*, not only is it possible to enhance the stiffness of the rib portion 1*c*, but it is also possible to increase the area of the base plate portion 1*a* that is joined to the body B, thereby yet further enhancing the stability with which the base plate portion 1*a* is supported on the body B.

Figure 5:
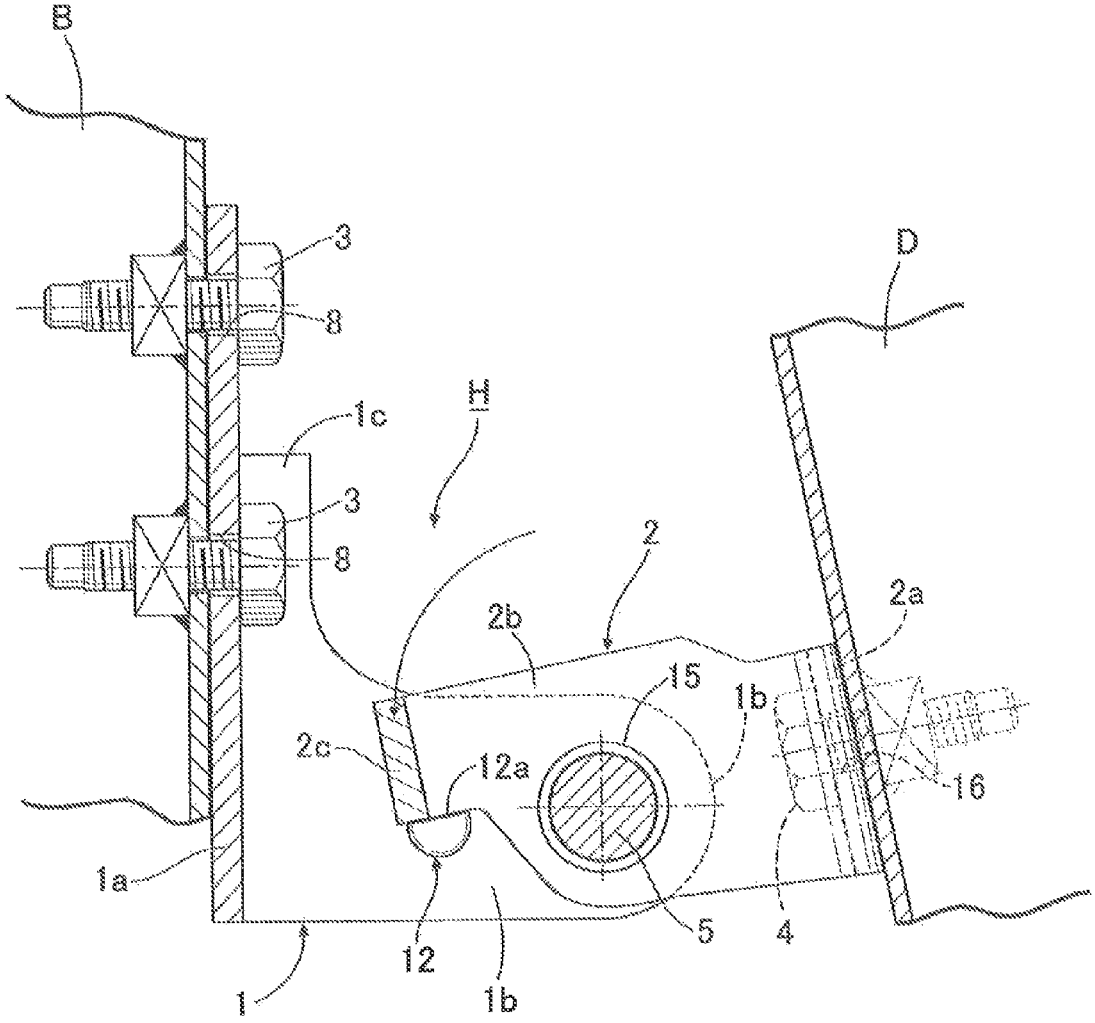
FIG. 5 is a sectional view along line 5-5 in FIG. 1. (first embodiment)

When the door D is being opened, as shown in FIG. 5, the fully open position of the door D is restricted due to the arm plate portion 2*b* of the second bracket 2 abutting against the flat stopper face 12*a* of the fully-open stopper projection 12 of the arm plate portion 1*b* of the first bracket 1. In this arrangement, since the flat stopper face 12*a* is in flat surface contact with the arm plate portion 2*b*, the contact surface pressure is held comparatively low and, moreover, since the stopper projection 12 has a semicircular cross-sectional shape, which has high stiffness, the durability can be maintained. Furthermore, since the stopper projection 12 is formed so as to bulge on the inside face of the arm plate portion 1*b*, there is no increase in the number of components, thus contributing to simplification of the structure.

A method for manufacturing the first bracket 1 is now explained by reference to FIG. 6.

Figure 6:
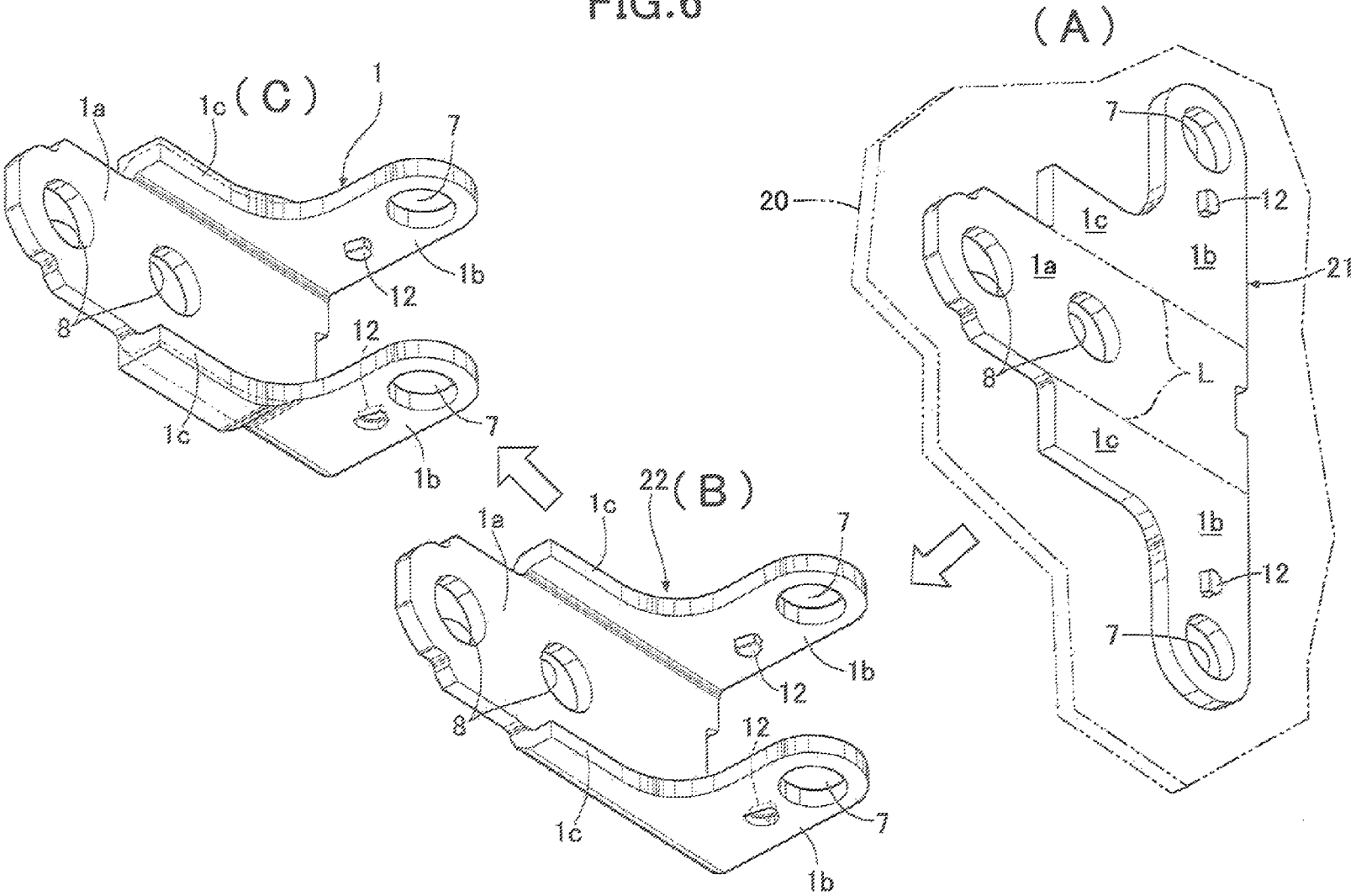
FIG. 6 is a diagram of production steps for a first bracket in the door hinge. (first embodiment)

First, as shown in FIG. 6 (A), a starting steel plate 20 is stamped using a press machine to form a flat plate bracket substrate 21 having portions corresponding to the base plate portion 1*a*, the arm plate portions 1*b* and 1*b*, and the rib portions 1*c* and 1*c*. In this process, the bolt holes 8 and 8 are bored in the base plate portion 1*a*, the pin holes 7 and 7 are bored in the arm plate portions 1*b* and 1*b*, and the stopper projections 12 and 12 are formed so as to bulge on the arm plate portions 1*b* and 1*b*.

Subsequently, as shown in FIG. 6(B), the base plate portion 1*a* of the bracket substrate 21 and the arm plate portions 1*b* and 1*b* and rib portions 1*c* and 1*c* are bent through right angles along boundary lines L and L using the press machine, thus giving a partially-finished bracket product 22.

Finally, as shown in FIG. 6(C), the rib portions 1*c* and 1*c* are subjected to upsetting in the height direction thereof, thus making the rib portions 1*c* and 1*c* thicker than the base plate portion 1 a and the arm plate portions 1*b* and 1*b*. The first bracket 1 is thus obtained.

In this way, the first bracket 1, which has the base plate portion 1*a* with opposite end parts open and the rib portions 1*c* and 1*c* having increased thickness, can be easily obtained by carrying out simple bending and upsetting, thus enabling a reduction in the processing cost to be achieved while enhancing the stiffness.

The present invention is not limited to the embodiment and may be modified in a variety of ways as long as the modifications do not depart from the spirit and scope thereof. For example, the present invention may be applied to a hinge for a tailgate door, a boot lid, an engine hood, etc. of an automobile.

The invention claimed is:

1. A door hinge for an automobile, comprising a first bracket fixed to an automobile body by a bolt, a second bracket fixed to a door, and a hinge pin pivotably linking these two brackets, the first bracket comprising a base plate having opposed ends along a horizontal axis, wherein one end of the opposed ends is fixed to the automobile body and an opposite end thereof attaches to the second bracket at a door side, the first bracket having a bolt hole through which the bolt is inserted, a pair of arm plates that rise upright from upper and lower edges of the baseplate at the end, on the door side and support the hinge pin, and a pair of ribs extending horizontally from each arm plate toward the one end of the base plate and rising upright from the upper and lower edges of the base plate perpendicular to the base plate, so as to oppose each other with the bolt hole interposed therebetween, wherein the opposed ends of the base plate are open, and each rib has a thickness in a direction perpendicular to the horizontal axis that is larger than a thickness of each arm plate in the direction perpendicular to the horizontal axis.

2. The door hinge for an automobile according to claim 1, wherein each rib is formed so that an outside face thereof protrudes more than an outside face of each arm plate.

3. The door hinge for an automobile according to claim 2, wherein a corner formed by an outside face of each rib and an outside face of the base plate is formed so as to be acute compared with a corner formed by the outside face of each arm plate and the outside face of the base plate.

4. The door hinge for an automobile according to claim 2, wherein in order to restrict a fully open position of the door a fully-open stopper projection having a semi-circular cross section with a flat stopper face that receives a corresponding arm plate of the second bracket is formed so as to bulge on an inside face of each arm plate of the first bracket.

5. The door hinge for an automobile according to claim 1, wherein a corner formed by an outside face of each rib and an outside face of the base plate is formed so as to be acute compared with a corner formed by the outside face of each arm plate and the outside face of the base plate.

6. The door hinge for an automobile according to claim 1, wherein in order to restrict a fully open position of the door a fully-open stopper projection having a semi-circular cross section with a flat stopper face that receives a corresponding arm plate of the second bracket is formed so as to bulge on an inside face of each arm plate of the first bracket.

7. A method for manufacturing the first bracket of the door hinge for an automobile according to claim 1, comprising a step of stamping out a starting steel plate to form a flat-plate bracket substrate having portions corresponding to the base plate, the arm plates, and the ribs, a step of bending each arm plate and each rib at right angles relative to the base plate of the bracket substrate to thus obtain a partially-finished bracket product, and a step of thickening each rib of the partially-finished bracket product by an upsetting process, the steps being carried out in sequence.

* * * * *